United States Patent [19]

Boden

[11] 4,274,157

[45] Jun. 23, 1981

[54] HAT OR CAP WITH ADJUSTABLE BAND

[76] Inventor: Ogden W. Boden, 1580 Gaywood Dr., Altadena, Calif. 91001

[21] Appl. No.: 900,758

[22] Filed: Apr. 27, 1978

Related U.S. Application Data

[63] Continuation-in-part of Ser. No. 879,054, Feb. 21, 1978, abandoned.

[51] Int. Cl.[3] ..... A42B 1/22

[52] U.S. Cl. ..... 2/181.4; 2/197

[58] Field of Search ..... 2/181, 181.2, 181.4, 2/182.1, 182.2, 182.6, 182.7, 183, 197, 417, 418

[56] References Cited

U.S. PATENT DOCUMENTS

| | | | |
|---|---|---|---|
| 77,007 | 4/1868 | Deas | 2/182.1 X |
| 221,313 | 11/1879 | Hoyt . | |
| 295,024 | 3/1884 | Lebkicher | 2/182.6 |
| 402,182 | 4/1889 | O'Connor . | |
| 482,429 | 9/1892 | O'Connor . | |
| 516,083 | 3/1894 | Davies . | |
| 663,311 | 12/1900 | Verhoven et al. . | |
| 707,784 | 8/1902 | Johnson | 2/182.7 X |
| 749,228 | 1/1904 | Runyan | 2/182.7 |
| 773,349 | 10/1904 | Strouse | 2/182.7 |
| 1,238,881 | 9/1917 | Buckingham | 2/182.7 |
| 1,321,544 | 11/1919 | Oetting | 2/181 |
| 1,434,743 | 11/1922 | Hardman . | |
| 1,530,870 | 3/1925 | Weber . | |
| 1,566,891 | 12/1925 | Lyon . | |
| 1,635,456 | 7/1927 | Bowditch | 2/181 |
| 1,907,709 | 5/1933 | Barrow . | |
| 2,067,657 | 1/1937 | Bullard | 2/181 |
| 2,112,808 | 3/1938 | Gray . | |
| 2,432,164 | 12/1947 | Kerr | 2/182.6 |
| 2,451,140 | 10/1948 | Wittcoff | 2/182.1 X |
| 2,628,361 | 2/1953 | Heyck . | |
| 2,832,077 | 4/1958 | McGinnis . | |
| 2,875,447 | 3/1959 | Goldmerstein . | |
| 3,128,474 | 4/1964 | Feldman . | |
| 3,245,088 | 4/1966 | Robison . | |
| 3,396,408 | 8/1968 | Enger | 2/183 |
| 3,495,272 | 2/1970 | Tempelhof . | |
| 3,780,382 | 12/1973 | Boden . | |
| 3,925,821 | 12/1975 | Lewicki . | |
| 4,011,600 | 3/1977 | Malk | 2/183 |
| 4,023,212 | 5/1977 | Huffman . | |
| 4,101,981 | 7/1978 | Boden | 2/182.6 |
| 4,131,953 | 1/1979 | Kimotsuki | 2/182.6 |

FOREIGN PATENT DOCUMENTS

| | | | |
|---|---|---|---|
| 283240 | 1/1914 | Fed. Rep. of Germany . | |
| 884067 | 7/1953 | Fed. Rep. of Germany . | |
| 492254 | 9/1938 | United Kingdom . | |
| 1019556 | 2/1966 | United Kingdom . | |
| 1273740 | 5/1972 | United Kingdom | 2/197 |

*Primary Examiner*—Robert Mackey
*Attorney, Agent, or Firm*—William P. Green

[57] ABSTRACT

A ventilated hat or cap having an adjusting band which is preferably formed as a moisture absorbent sweat band, and which extends along the inside of the primary band structure of the hat, in spaced relation thereto to allow circulation of air upwardly and downwardly through a gap between the two bands, and with at least one and preferably both of the ends of the adjusting band being connected to the primary band structure for relative longitudinal adjusting movement in a relation varying the effective size of the hat or cap.

8 Claims, 13 Drawing Figures

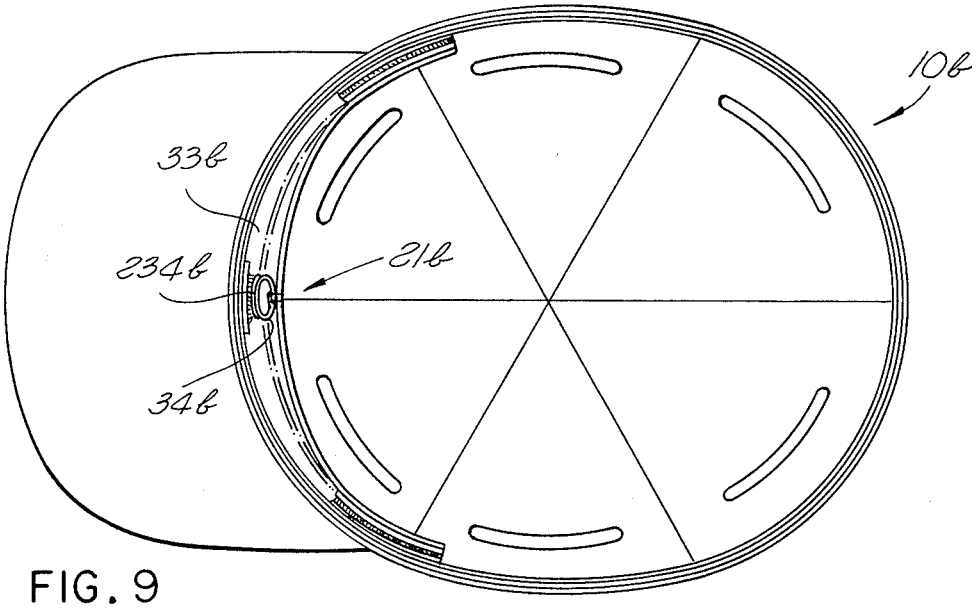
FIG. 9
FIG. 10
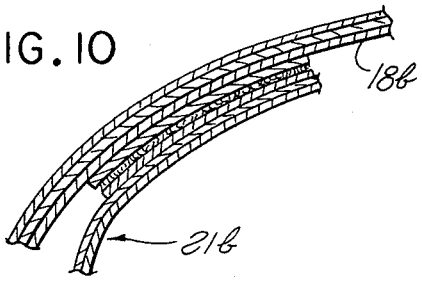
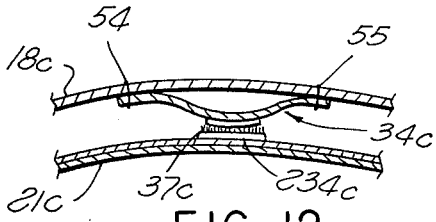
FIG. 12
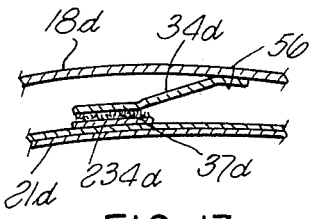
FIG. 13
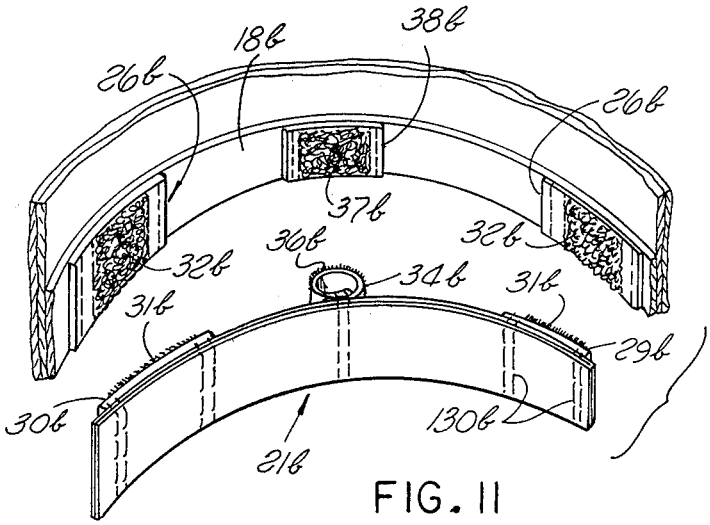
FIG. 11

HAT OR CAP WITH ADJUSTABLE BAND

This application is a continuation-in-part of my copending application Ser. No. 879,054 filed Feb. 21, 1978 on "Ventilated Hat or Cap With Adjustable Band," now abandoned.

BACKGROUND OF THE INVENTION

This invention relates to improved hats or caps which have a unique type of adjustability, and which are desirably constructed to provide a passage or passages for circulation of air between the inside and outside of the crown of the hat or cap to prevent overheating of a user's head.

In my prior U.S. Pat. No. 3,780,382, and in my applications Ser. No. 787,839 filed Apr. 15, 1977 and Ser. No. 838,816 filed Oct. 3, 1977, now abandoned, I have disclosed certain types of head gear in which a space is maintained between a user's head and the main hat or cap band, to allow circulation of air upwardly through that space or gap into the crown of the hat or cap, or downwardly from within the crown to the outside of the hat or cap. In addition, the crown itself contains apertures for permitting further circulation of air into and out of the crown. There have also been provided in the past various types of helmets or other headgear in which inner bands or straps have been spaced from the helmet or cap in a manner leaving air spaces between those inner straps and the surrounding portion of the helmet or cap. Other prior art hats or caps have included sweat bands at the inside of a main band structure for absorbing moisture from a user's head.

SUMMARY OF THE INVENTION

A hat or cap embodying the present invention includes a crown having a primary band extending along the bottom edge of the crown, and having at the inside of that primary band a secondary adjusting band which is connected to the primary band at two locations but between those locations is spaced from the primary band for circulation of air upwardly and downwardly therebetween. The secondary band is secured to the primary band adjustably at at least one of the two specified locations, and preferably at both of those locations, to be relatively shiftable in a manner varying the effective overall size of the hat or cap. In the preferred arrangement, the opposite ends of the adjusting band are secured to the primary band by velcro fasteners, allowing for detachability of the adjusting band and also the desired relative shifting or adjusting movement at both ends thereof. The adjusting band is for best results formed of a moisture absorbent material, and functions as a sweat band for absorbing moisture from the user's head, with the detachability of the band permitting its complete removal for washing or cleaning.

At a point intermediate the opposite ends of the adjusting band, an additional connection is desirably provided between the two bands. This additional connection may be a collapsible structure capable of maintaining a connection between the two bands when they are in different spaced relationships corresponding to different settings of the detachable connections at the ends of the adjusting band. This collapsible connection may be formed as a simple tube of flexible material which can be partially or totally flattened to reduce the spacing between the bands, and which may be permanently connected to one of the bands and detachably connectable to the other band by a Velcro fastener arrangement.

In certain forms of the invention, the spacing between the main band and adjusting band may be enhanced by providing spacer elements between the bands at the ends of the adjusting band. These spacers may be cushion elements, pivotally movable parts capable of assuming different positions conforming to the contour of a user's head, or any other appropriate spacer structure.

BRIEF DESCRIPTION OF THE DRAWINGS

The above and other features and objects of the invention will be better understood from the following detailed description of the typical embodiments illustrated in the accompanying drawings, in which:

FIG. 9 is a bottom plan view similar to FIG. 2 of another variational arrangement;

FIG. 10 is an enlarged section similar to FIG. 4 but showing the variational form of FIG. 9;

FIG. 11 is a fragmentary perspective view of the FIGS. 9 and 10 cap; and FIGS. 12 and 13 are views similar to FIG. 3 of two other variational arrangements.

DESCRIPTION OF THE PREFERRED EMBODIMENTS

Figure 1:
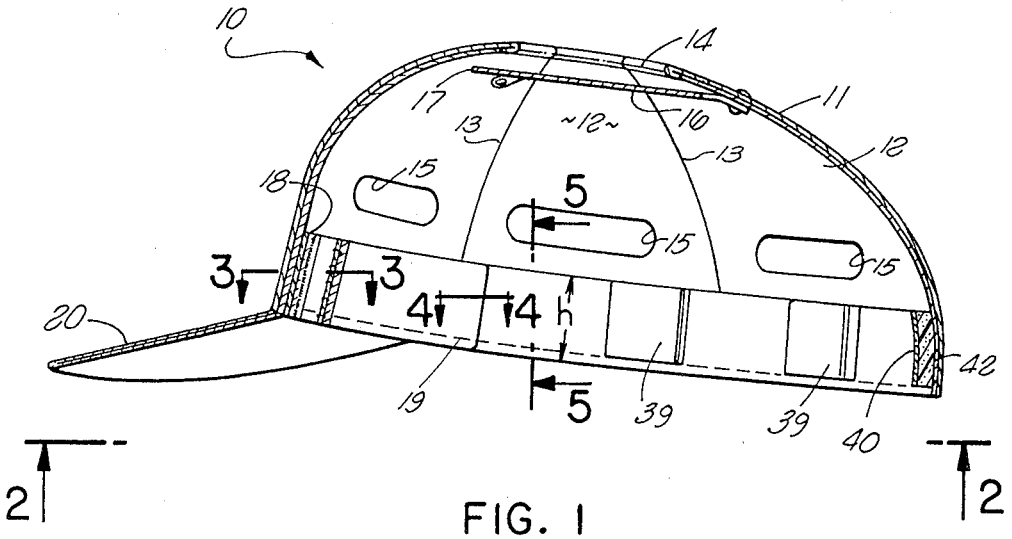
FIG. 1 is a vertical front to rear sectional view through a first form of cap constructed in accordance with the invention, and taken on line 1—1 of FIG. 2.

The cap 10 of FIGS. 1 to 5 includes a crown 11 which may be formed of a number of sections 12 stitched together along upwardly converging lines 13. In accordance with the teachings of my above mentioned prior patent and applications, the crown desirably has a top central opening 14 and a series of side openings 15 through which air may circulate into and out of the crown. A baffle 16 may be spaced beneath top opening 14 to prevent direct impingement of the rays of the sun on the user's head while at the same time permitting circulation of air into and out of the crown past an edge 17 of the baffle.

Extending along the bottom of the crown 11, and about the user's head, the cap includes a primary hat or cap band 18 which may be simply a strip of cloth, leather, or the like. It is also contemplated that this primary band of the cap may be formed merely as the lower edge portion of the material forming the crown itself, though in most instances a separate band part is preferred. The band 18 may be appropriately stitched or otherwise secured to the crown, as by stitching represented at 19. A bill 20 projects forwardly from the front portion of the crown and band 18.

Figure 2:
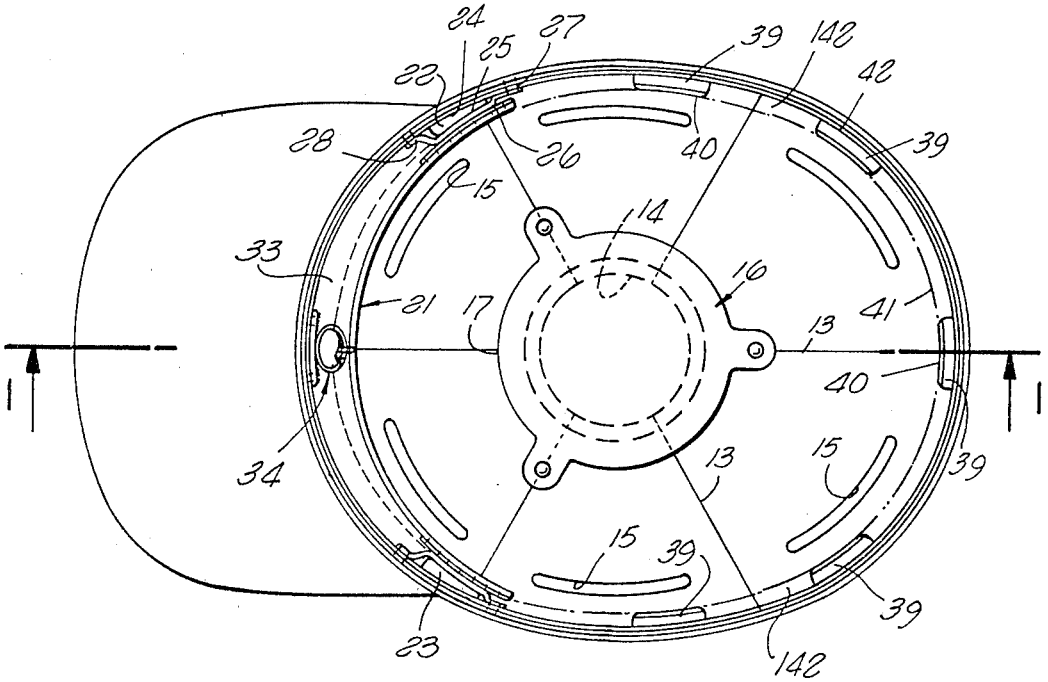
FIG. 2 is a bottom plan view of the cap taken on line 2—2 of FIG. 1.

Referring now to FIG. 2, the cap includes at the inside of the forward portion of the band 18 a removable adjusting sweat band element 21, which contacts the user's forehead and absorbs moisture therefrom. The opposite end portions of sweat band 21 are secured to the primary band 18 at the locations of a pair of spacer elements 22 and 23, which may take the form of two typically rectangular resiliently deformable cushions of foam rubber or foam plastic material or the like. The outer surface 24 of each of these cushions 22 may be essentially planar and appropriately adhered or otherwise secured to the inner surface of band 18. The inner surface 25 of the cushion may also be essentially planar and spaced inwardly from outer surface 24.

For securing the sweat band to the cap, there may be provided at the location of each of the cushioning pads 22 and 23 a strip of Velcro material 26, which extends across the inner surface 25 of cushion 22 or 23, and then is stitched at the opposite sides of that cushion to band 18, as represented at 27 and 28 in FIG. 2. Two coacting strips of Velcro material 29 and 30 are secured to the outer surface of sweat band 21, at opposite ends thereof, as by stitching at 130, with these Velcro strips 29 and 30 having a large number of hook shaped resiliently deformable projections 31 adapted to detachably interlock with inter-engageable resiliently deformable projections 32 on the cap carried Velcro strips 26, to secure the ends of the sweat band to the two spacer elements 22 and 23 in any of a number of different longitudinally adjusted positions relative to band 18. The connection between these Velcro elements is normally such as to leave a gap or space 33 radially between the sweat band 21 and the opposed portion of main or primary band 18, so that air may circulate upwardly and downwardly through that gap 33 and between the interior of the crown and its exterior.

The sweat band 21 is formed of a material capable of absorbing moisture when the user perspires. The material presently preferred for this purpose is terry cloth, which may be relatively heavy to effectively serve the moisture absorption purpose. Several layers of such terry cloth may be stitched together to form a sweat band of an appropriate thickness.

Figure 3:
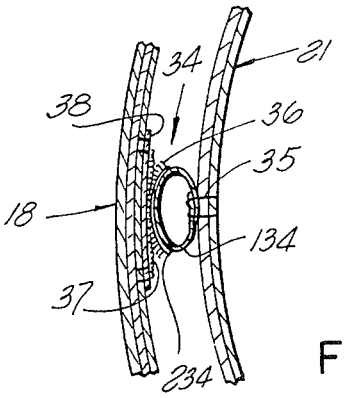
FIGS. 3 and 4 are enlarged fragmentary horizontal sections taken on lines 3—3 and 4—4 respectively of FIG. 1.
Figure 4:
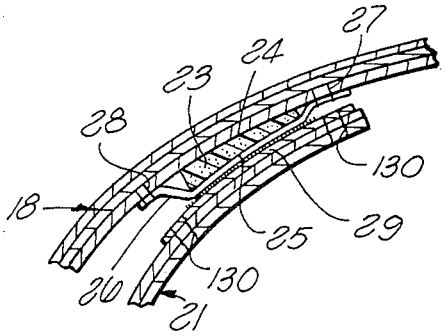
Figure 5:
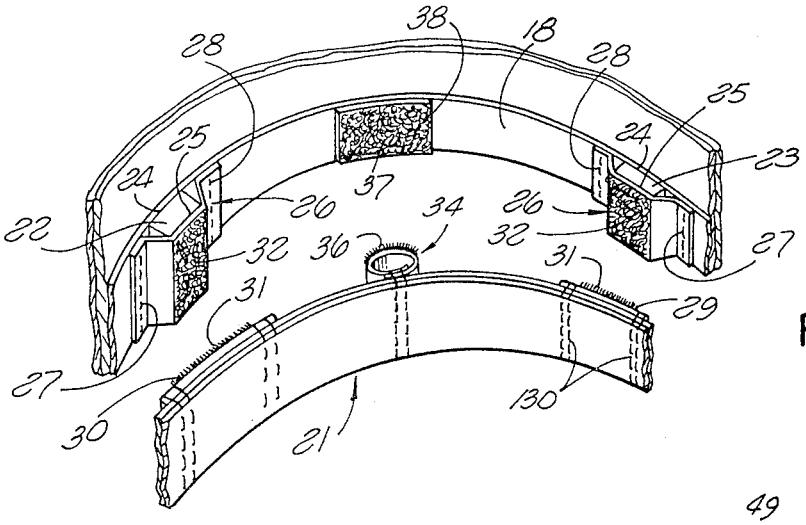
FIG. 5 is a fragmentary exploded perspective view of the adjustable and removable sweat band of FIG. 1 and the portion of the primary hat band to which it is connectable.

At its longitudinal center, the sweat band 21 carries at its forward side a part 34 by which the central portion of the sweat band is detachably connectable to the front central portion of band 18. This part 34 may be formed of a strip 134 of cloth or other material, looped to form a tube as shown in FIGS. 2, 3 and 5, with the opposite ends of the strip overlapping and stitched to the center of the sweat band 21 at 35, and with a narrow strip 234 of Velcro material secured to loop 134. This Velcro strip 234 has a large number of hook shaped Velcro projections of fingers 36 at its forward side which are detachably interlockable with projections 37 formed on a narrow band 38 of Velcro material carried by band 18. As will be apparent, the tube 34 can collapse to a partially or totally flattened condition corresponding to different spaced relationships between sweat band 21 and the opposed portion of band 18.

Rearwardly of the opposite ends of sweat band 21, the main band 18 of the cap may carry a number of additional spacer elements 39, typically formed of a resiliently deformable foam cushion material as discussed in connection with spacers 22 and 23, and having inner surfaces 40 positioned to contact the user's head 41 at spaced locations. The outer surface 42 of each of the cushions 39 may be appropriately adhered or otherwise secured to the main band 18. The main band 18 has just sufficient stiffness to remain in spaced relation to the outer surface of the user's head at the locations circularly between the various spacers 22, 23 and 39, to provide gaps 42 intermediate the spacers through which air may circulate upwardly and downwardly into and out of the crown.

In using the cap of FIGS. 1 to 5, a user connects the two Velcro strips 29 and 30 at opposite ends of sweat band 21 to the Velcro strips 26 at the inner sides of spacers 22 and 23, and secures the central collapsible tubular element 34 to band 18 by its Velcro projections. He may try on the cap with the ends of the sweat band 21 connected in different longitudinally adjusted positions relative to the spacer elements 22 and 23, to vary the effective length of the sweat band 21 between those spacer elements, and thereby in effect vary the size of the cap. In this way, he can adjust the cap to exactly fit his head, and thereafter leave the sweatband in that adjusted position. Assuming that the correct adjusted setting for a particular person is that illustrated in full lines in FIG. 2, it is noted that when the user places the cap so adjusted on his head there are air circulation gaps provided at different locations entirely about his head. Across the front of the head, the gap 33 is provided, interrupted only at the location of the connector 34, and at the sides and back there are a number of the gaps 42. The free circulation of air upwardly and downwardly past his head and into and out of the crown, as well as the circultion of air through crown openings 14 and 15, maintains the head in a very cool condition. Any perspiration which is produced at the location of the user's forehead is absorbed by the sweat band 21. After an extended period of use, this band 21 may be completely detached from the cap by virtue of the Velcro connections, and be washed or dry cleaned and then replaced in the cap.

If a person with a larger head uses the cap, the ends of the sweat band 21 are shifted horizontally relative to the spacer elements 22 and 23, and are then connected in those changed positions to the spacer structures through the Velcro elements. For example, the band may be shifted along the spacer structures to an effectively increased length condition represented in broken lines in FIG. 2, in which the flexible tube 34 is collapsed to a somewhat flattened condition while still maintaining the connection between the sweat band and main band 18. Thus, the sweat band may be adjusted to any of many different settings, in which the gap 33 at the front of the cap has different front to rear widths. In an extreme position, the sweat band 21 may be in direct engagement with band 18 along most or all of the distance between the spacer structures 22 and 23, to allow use on a head of maximum size. The central connection between the two bands attained by part 34 facilitates handling of the cap as a unit, and permits the cap to be placed onto and off of a user's head without concern as to whether the sweat band 21 may be displaced upwardly or downwardly relative to the band 18. This result is attained by the connector 34 in all of the various discussed conditions of that connector, that is, whether it is in a cylindrical or flattened condition.

Figure 7:
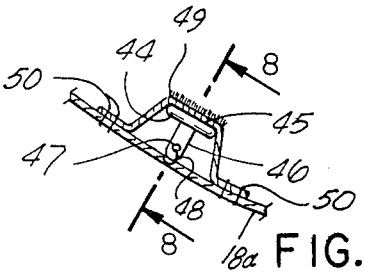
FIG. 7 is an enlarged fragmentary section through a portion of the FIG. 6 device.
Figure 6:
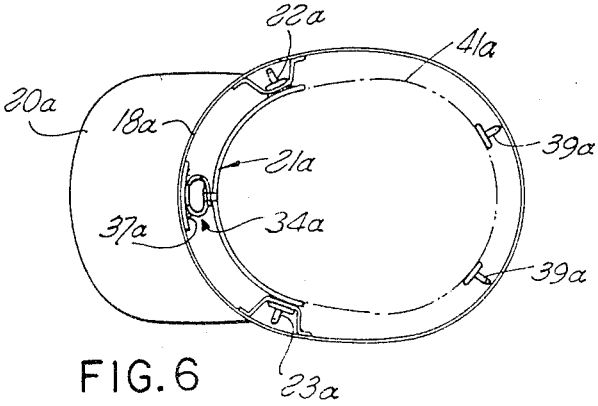
FIG. 6 is a reduced scale bottom plan view similar to FIG. 2 but showing a variational form of the invention.
Figure 8:
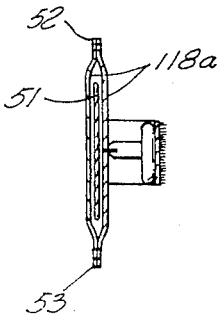
FIG. 8 is a fragmentary vertical section taken on line 8—8 of FIG. 7.

FIGS. 6 through 8 show a variational arrangement in which there are substituted for the spacer elements 22, 23 and 39 four essentially rigid pivotally mounted spacers **22*a*, 23*a* and 39*a*. Each of these spacers may be of a type similar to that shown in prior application Ser. No. 787,839. More particularly, each spacer may have an inner enlarged head portion 44 having a flat surface 45 facing inwardly toward the user's head, with a reduced dimension shank 46 of the spacer having an opening 47 through which thread or a fastening element 48 extends for securing the spacer to the main band 18*a* (corresponding to band 18 of FIGS. 1–5). Velcro material 49 may extend along the inner side of each of the spacer elements, and be stitched to band 18***a* at 50, but with the velcro material being sufficiently loose to allow the discussed limited pivotal movement of the spacer part to assume a position corresponding to the contour of the opposed portion of the user's head. The sweat band 21*a* of FIG. 6 may be identical with band 21 of the first form of the invention, and may carry a central collapsible connector tube 34*a*having Velcro projections detachably connectable to a strip of Velcro material 37*a* attached to the center of the front portion of band 18*a*. The two rear spacers 39*a* may engage the back portion of the user's head at opposite sides thereof. In order to maintain the proper spacing between the user's head 41*a* and band 18*a* with a reduced number of the spacers 22*a*, 23*a* and 39*a*, the band 18*a* may contain a stiffening element positively preventing inward deflection of the band 18*a* from the normal spaced relation of FIG. 6 with respect to the user's head. This stiffening element may be a wire or wires extending along the periphery of band 18*a*, or may be a thin strip of fairly stiff resinous plastic material 51 (FIG. 8) confined within a pocket formed by two layers 118*a* of fabric forming the band 18*a*. These two layers 118*a* may be stitched together at their upper and lower edges 52 and 53, above and beneath the stiffening strip 51. Desirably, strip 51 continues along the entire circular extent of band 18*a*, though it is contemplated that if desired this band 51 may be interrupted at the front of the gap at the location at which bill 20*a* serves by itself to maintain sufficient stiffness in the band 18*a*.

The cap of FIGS. 6 to 8 is used in essentially the same manner as has been discussed in connection with the first form of the invention, with the sweat band 21*a* being adjustable relative to spacer elements 22*a* and 23*a* to vary the effective length of the sweat band between those spacer elements, and thus adjust the cap to precisely fit a particular size head. In use, the spacing maintained between the band 18*a* and the user's head, essentially entirely about the user's head, serves the same cooling purpose discussed in connection with FIGS. 1 to 5.

FIGS. 9 to 11 show another variational form of cap 10*b* which may be essentially the same as that shown in FIGS. 1 to 5 except for deletion of the spacer cushions 22, 23 and 39 which are carried at the inner side of the main hat band in FIGS. 1 to 5, and deletion of the top opening in the crown and the associated baffle 16. The adjustable and removable sweat band 21*b* of FIGS. 9 to 11 may be identical with the sweat band 21 of the first form of the invention, having Velcro strips 29*b* and 30*b* secured by stitching 130*b* to its opposite ends, and having a flexible collapsible tubular connecting part 34*b* stitched to the sweat band and including a strip 234*b* of Velcro material corresponding to that shown at 134 in FIG. 3.

The main band 18*b* of the cap of FIGS. 9 to 11 has two Velcro strips 26*b* stitched to its inner surface at the locations of the strips 26 of FIG. 1. A central Velcro strip 38*b* is stitched to the inner surface of band 18*b* midway between the two strips 26*b*. All three of these strips 26*b* and 38*b* lie flat against the inner surface of main band 18*b*, without the spacing attained by the cushions 22 and 23 of FIGS. 2 and 5. As a result, the hook shaped resiliently deformable Velcro projections 31*b* on the strips 29*b* and 30*b* at opposite ends of the sweatband are interengageable in detachably interlocking relation with the resiliently deformable projections 32*b* at the inner sides of the main hat band, in a manner securing the opposite ends of the sweat band to the hat band in closely proximate essentially unspaced relation. At the same time, however, the central portion of the sweat band is secured to main band 18*b*, by interlocking engagement of the hook shaped Velcro projections or fingers 36*b* on loop 34*b* with projections 37*b* on strip 38*b*.

For most head sizes, the central portion of the sweat band 21*b* is in spaced relation to the main band 18*b* as in FIG. 9, to provide an air gap 33*b* between these parts through which air may circulate upwardly and downwardly into and out of the crown of the cap. A user connects the Velcro strips at the opposite ends of sweat band 21*b* to the Velcro strips carried by the hat band in a position adjusting the effective head size of the cap to exactly fit his particular head. As in the other forms of the invention, the collapsible loop 34*b* maintains a connection between the sweat band and the main band 18*b* of the cap at the center of the sweat band in any desired adjusted setting of the sweat band, even in a fully collapsed condition of the loop or tube 34*b* in which the sweat band essentially follows main band 18*b* in unspaced relation. Except in this maximum head size condition of the sweat band, an air circulation gap 33*b* of substantial width is provided at the front of the sweat band. When the sweat band requires cleaning, it may be easily detached from the cap, washed, and then connected back into the cap in a properly adjusted setting.

FIG. 12 is a horizontal sectional view similar to FIG. 3 but showing another variational arrangement utilizing a different type of central connector element 34*c* in lieu of the tubular connectors 34, 34*a* and 34*b*. The element 34*c* of FIG. 9 takes the form of a short strip of flexible cloth or other flexible material stitched or otherwise secured at its opposite ends 54 and 55 to the main hat band 18*c*, and carrying a Velcro strip 37*c* detachably connectable to a second Velcro strip 234*c* stitched to the central portion of removable sweat band 21*c*. The opposite ends of the sweat band are detachably connectable by Velcro elements to the main hat band as previously discussed. As will be understood, the strip 34*c* can collapse in a manner allowing it to secure the two bands together when the inner sweat band 21*c* is spaced different distances from band 18*c*, or when the two bands are in direct engagement with one another along substantially the entire length of the sweat band.

FIG. 13 shows another arrangement in which a flexible connector strip 34*d* is stitched at only one end 56 to the main band 18*d*, and carries a Velcro strip 37*d* at its opposite end detachably connectable to a coacting Velcro strip 234*d* on the inner sweat band 21*d*. As in the other forms of the invention, the strip 34*d* forms a connection which will secure the two bands together in any of various different spaced relationships, and also when the two bands are in contact with one another, to allow the desired adjustment of the head size while at the same time securing the sweat band to the main band at a central location.

While certain specific embodiments of the present invention have been disclosed as typical, the invention is of course not limited to these particular forms, but rather is applicable broadly to all such variations as fall within the scope of the appended claims.

I claim:

1. A ventilated hat or cap comprising:

a crown;

means forming a primary band at the bottom of said crown;

an inner adjusting sweat band extending along an inner side of said primary band at a location to engage and extend across the front of a user's head and having two ends essentially at opposite sides of the user's head;

first and second connections at said two ends respectively of said inner band connecting said ends thereof to said primary band at opposite sides of the user's head;

each of said connections including two sets of Velcro projections carried by said two bands respectively and interengageable to secure the corresponding end of the inner band to the primary band detachably and in any of a series of different positions adjusted longitudinally of the primary band, in a relation adjusting the effective size of the hat or cap, and in at least some settings of said connections maintaining an air circulation gap between the primary band and the inner band, with the width of said gap varing in correspondence with the setting of said connections; and a third detachable connection between said bands at an intermediate location circularly between said first and second connections and attaching said bands together in any of different spaced relationships in different settings of the first and second connections;

said third connection including a flexible attaching tube secured to one of said bands at said intermediate location, first Velcro projections carried by said attaching tube, and second Velcro projections carried by the other band and detachably connectible to said first Velcro projections carried by said attaching tube;

said attaching tube being adapted to flex in a relation permitting movement of said first Velcro projections carried thereby toward and away from said one band, to thereby maintain the attachment between said bands at said intermediate location in said different spaced relationships of the bands, and permitting complete detachment of the inner band by separation of the Velcro projections of all of said first, second and third connections.

2. A ventilated hat or cap as recited in claim 1, in which said inner adjusting band is formed at least in part of a moisture absorbent material positioned to contact the user's head and absorb moisture therefrom.

3. A ventilated hat or cap as recited in claim 1, in which said inner adjusting band is formed of terry cloth positioned to contact a user's head and absorb moisture therefrom.

4. A ventilated hat or cap as recited in claim 1, including two spacer elements at the locations of said first and second connections and maintaining the adjusting band in inwardly spaced relation to said primary band at said first and second connections respectively.

5. A ventilated hat or cap as recited in claim 4, in which said spacer elements are deformable cushioning parts secured to said primary band and interposed between it and said Velcro projections of said first and second connections.

6. A ventilated hat or cap as recited in claim 4, in which said two spacer elements are connected to said primary band for essentially universal shifting movement relative thereto and are interposed between said primary band and said Velcro projections of said first and second connections.

7. A ventilated hat or cap comprising:

a crown;

means forming a primary band at the bottom of said crown;

an inner adjusting sweat band extending along an inner side of said primary band at a location to engage and extend across the front of a user's head and having two ends essentially at opposite sides of the user's head;

first and second connections at said two ends respectively of said inner band connecting said ends thereof to said primary band at opposite sides of the user's head;

each of said connections including two sets of Velcro projections carried by said two bands respectively and interengageable to secure the corresponding end of the inner band to the primary band detachably and in any of a series of different positions adjusted longitudinally of the primary band, in a relation adjusting the effective size of the hat or cap, and in at least some settings of said connections maintaining an air circulation gap between the primary band and the inner band, with the width of said gap varying in correspondence with the setting of said connections; and a third detachable connection between said bands at an intermediate location circularly between said first and second connections and attaching said bands together in any of different spaced relationships in different settings of the first and second connections;

said third connection including a flexible attaching tube secured at one side thereof to one of said bands at said intermediate location, first Velcro projections on the opposite side of said attaching tube, and second Velcro projections carried by the other band and detachably connectible to said first Velcro projections on the tube;

said attaching tube being adapted to flex in a relation permitting movement of said first Velcro projections carried thereby toward and away from said one band, to thereby maintain the attachment between said bands at said intermediate location in said different spaced relationships of the bands, and permitting complete detachment of the inner band by separation of the Velcro projections of said first, second and third connections.

8. A ventilated hat or cap as recited in claim 7, in which said attaching tube is secured to and removable with said inner band.

* * * * *